US008397916B1

(12) United States Patent
Cassidy et al.

(10) Patent No.: US 8,397,916 B1
(45) Date of Patent: Mar. 19, 2013

(54) HIGH DURABILITY FEET FOR CORRUGATED SHIPPING CONTAINERS

(76) Inventors: Robert E. Cassidy, Lebanon, NH (US); David P. Goodrich, Newtown, CT (US)

( * ) Notice: Subject to any disclaimer, the term of this patent is extended or adjusted under 35 U.S.C. 154(b) by 213 days.

(21) Appl. No.: 11/799,704

(22) Filed: May 2, 2007

Related U.S. Application Data

(60) Provisional application No. 60/796,961, filed on May 2, 2006.

(51) Int. Cl.
*B65D 19/20* (2006.01)

(52) U.S. Cl. ..... 206/599; 206/386; 108/51.3; 108/56.3

(58) Field of Classification Search ..... 206/386, 206/600, 503, 598, 599, 586; 108/51.3, 56.1, 108/56.3
See application file for complete search history.

(56) References Cited

U.S. PATENT DOCUMENTS

| | | | | | |
|---|---|---|---|---|---|
| 1,807,770 | A | * | 6/1931 | Beaman | 206/586 |
| 1,852,832 | A | * | 4/1932 | Beaman | 206/586 |
| 2,494,730 | A | * | 1/1950 | Thursby | 206/386 |
| 2,503,240 | A | * | 4/1950 | Cahners | 108/51.3 |
| 2,576,715 | A | * | 11/1951 | Farrell | 108/51.3 |
| 2,702,682 | A | * | 2/1955 | Newsom | 108/51.3 |
| 2,728,545 | A | * | 12/1955 | Hermitage | 108/51.3 |
| 2,798,685 | A | * | 7/1957 | Mooney | 108/51.3 |
| 2,818,972 | A | * | 1/1958 | Claus | 206/386 |
| 2,906,481 | A | * | 9/1959 | O'C Parker | 108/51.3 |
| 2,997,266 | A | * | 8/1961 | Munroe | 108/51.3 |
| 3,236,197 | A | * | 2/1966 | Rossner | 108/51.3 |
| 3,519,190 | A | * | 7/1970 | Achermann et al. | 206/599 |
| 3,911,182 | A | * | 10/1975 | Lieberman | 428/12 |
| 3,940,101 | A | * | 2/1976 | Heidelbach | 108/51.3 |
| 4,714,026 | A | * | 12/1987 | Yamaguchi et al. | 108/57.29 |
| 4,831,938 | A | * | 5/1989 | Atterby et al. | 108/51.3 |
| 4,863,024 | A | * | 9/1989 | Booth | 108/51.3 |
| 5,129,329 | A | * | 7/1992 | Clasen | 108/51.3 |
| 5,327,839 | A | * | 7/1994 | Herring et al. | 108/51.3 |
| 5,370,229 | A | * | 12/1994 | Kroeckel et al. | 206/586 |
| 5,465,672 | A | * | 11/1995 | Boyse et al. | 108/51.3 |
| 5,592,885 | A | * | 1/1997 | Young et al. | 108/51.3 |
| 5,603,258 | A | * | 2/1997 | Besaw | 108/51.3 |
| 5,809,903 | A | * | 9/1998 | Young, Jr. | 108/51.3 |
| 5,996,510 | A | * | 12/1999 | Harpman et al. | 108/51.3 |
| 6,070,726 | A | * | 6/2000 | Graham | 108/51.3 |
| 6,095,061 | A | * | 8/2000 | Perazzo | 108/51.3 |
| 6,135,030 | A | * | 10/2000 | Besaw | 108/51.3 |
| 6,453,827 | B1 | * | 9/2002 | Perazzo | 108/51.3 |
| 6,619,477 | B2 | * | 9/2003 | Takahashi | 206/386 |
| 7,086,338 | B2 | * | 8/2006 | Horiuchi | 108/51.3 |
| 2007/0221102 | A1 | * | 9/2007 | Reinhall | 108/57.12 |

* cited by examiner

*Primary Examiner* — Andrew Perreault
(74) *Attorney, Agent, or Firm* — Sheldon Parker, Esq

(57) ABSTRACT

A foot for a corrugated shipping container, comprising a spiral of corrugated board legs having a fastener retaining plank inner core. An inner layer of an impact absorbing foam can be used within the spiral. The inner core can also be a corrugated inner layer sandwiched between a pair of plywood planks. A plurality of legs is secured to a base member, corrugated or wood, by a plurality of fasteners, with each leg having a plurality of feet. The fasteners, such as nails, extend through the corrugated layers to the plank layer. A plywood plank can be placed between the base member and each of the legs. The feet can also be manufactured from a composite having a plurality of layers, including one or more planks, corrugated blank and an impact absorbing foam inner core. The base can be used to retain a corrugated shipping container.

1 Claim, 11 Drawing Sheets

FIGURE 11
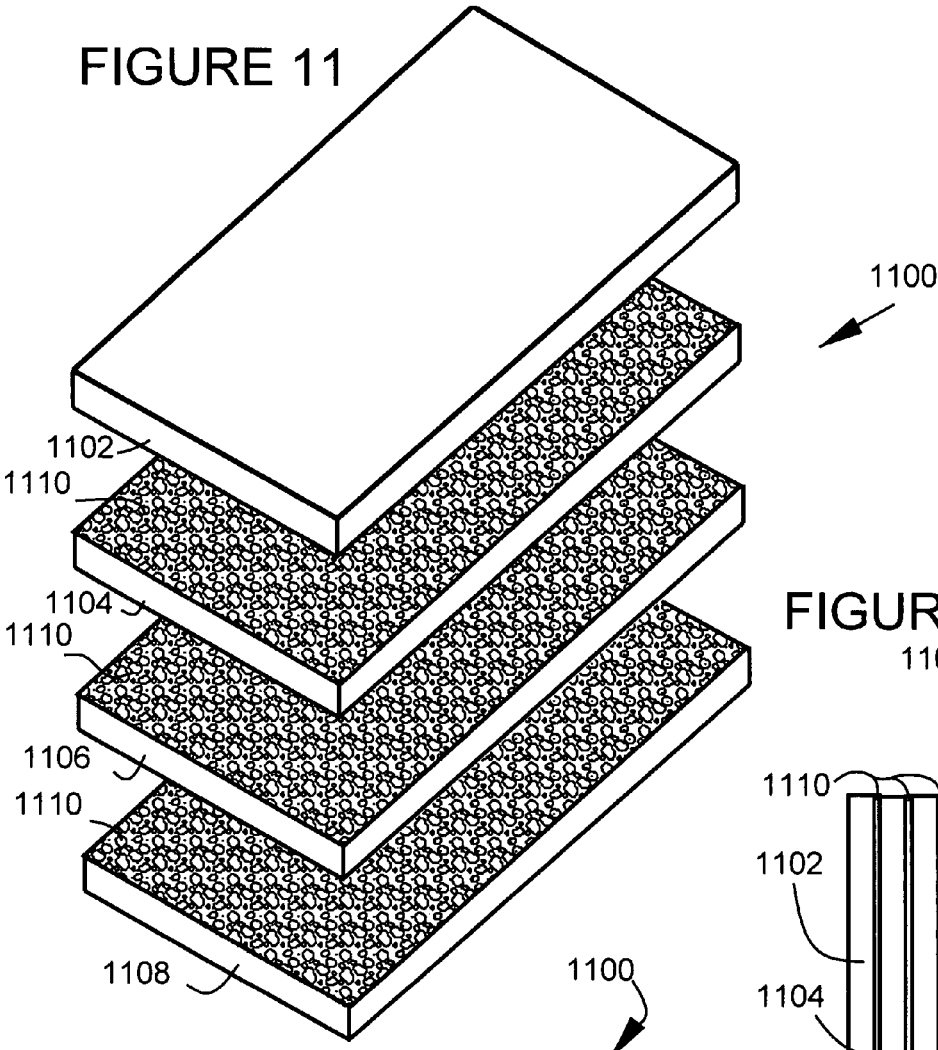
FIGURE 12
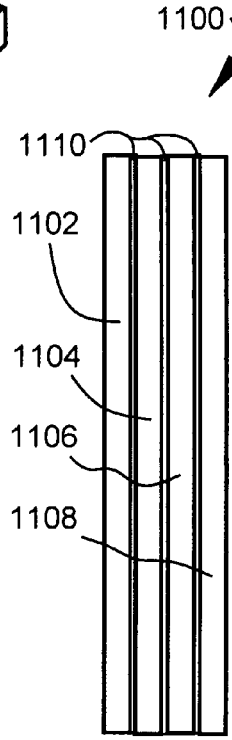
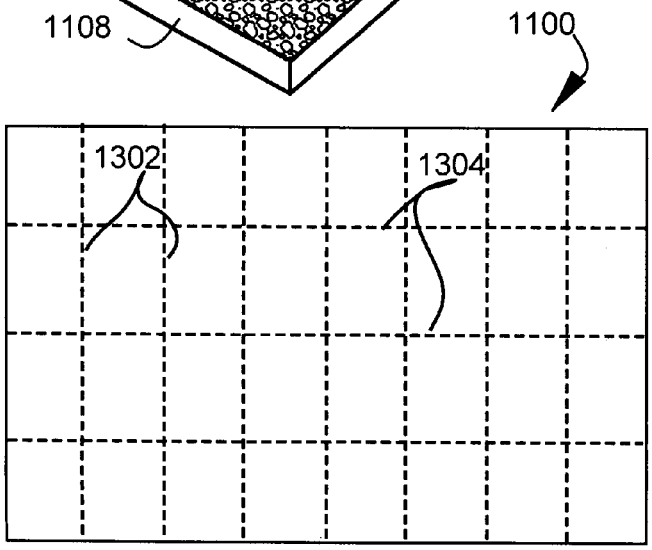
FIGURE 13

HIGH DURABILITY FEET FOR CORRUGATED SHIPPING CONTAINERS

This application claims the benefit of provisional patent application 60/796,961 for High Durability Feet for Corrugated Shipping Containers, filed May 2, 2006, the disclosure of which is incorporated herein as though recited in full.

BACKGROUND

1. Field of the Invention

The present invention relates generally to the transportation of shipping containers, and in particular, corrugated crates, and more specifically, to high durability legs for crates, or the pallets on which crates are transported and stored, and particularly to legs having a plurality of feet formed of corrugated paper optionally spiral wound, and interleaved with plywood, fiberboard, or the like, and optionally with a impact absorbing material such as foam.

2. Background of the Invention

Wooden pallets and corrugated pallets that followed have historically been made with 4" legs to accommodate the forks that lift the pallet. The standard started with the use of 2"×4" standard lumber. Pallets are now manufactured in a variety of ways. Rather than using lumber, strips of corrugated have been glued together to form feet and then glued to a top and bottom pad. However, the corrugated feet loose their strength and form when subjected to water, as for example, during a rainstorm and are subject to being deformed when struck by the forks of a fork lift or when a crate is pushed rather than being lifted and moved.

There is a need to avoid the use of softwood in shipping containers due to the associated problem of infestations. The cost of fumigating or otherwise rendering wood safe for international shipping, or disposing of wood is not merely an inconvenience, but is costly. There is also a need for a pallet having the durability of wood and the convenience of corrugated board.

Another problem that has been encountered is the tendency for feet to be torn from the container during shipping of a container and/or lateral movement of the container.

SUMMARY

According to a first broad aspect of the present invention, there is provided a pallet or other shipping platform and/or container having spiral wound corrugated paper feet interleaved with at least one plank for retaining a securing fastener that extends into the plank.

According to another broad aspect of the present invention, there is provided a pallet and/or container having spiral wound corrugated paper feet interleaved with at least one plank of fiberboard, plywood, oriented stranded material, or equivalent fastener retaining material.

According to a another broad aspect of the present invention, there is provided a pallet or other shipping platform, and/or a container, and having spiral wound corrugated paper feet interleaved with at least one plank for retaining a securing fastener that extends into the plank and an impact absorbing foam material.

According to a further broad aspect of the present invention, there is provided a pallet or other shipping platform and/or container and spiral wound corrugated paper feet interleaved with at least one plank for retaining a securing fastener that extends through the shipping platform and/or container and into the plank, and having shrink wrap covering surrounding and waterproofing said corrugated paper feet.

According to another broad aspect of the present invention, there is provided a pallet or other shipping platform and/or container having a plurality of layers of corrugated paper feet interleaved with at least one plank for retaining a securing fastener that extends into the plank, and a securing fastener that extends through the shipping platform and/or container and into the plank.

According to another broad aspect of the present invention, feet are provided having a plurality of layers of corrugated board, and a core of at least one plank, where the plank is fiberboard, plywood, oriented stranded material, or an equivalent fastener retaining material.

According to another broad aspect of the present invention, there is provided a pallet and/or shipping container having laminated corrugated paper feet interleaved with at least one fastener retainer plank and optionally, an impact absorbing foam material.

According to another broad aspect of the present invention, feet are provided having a plurality of layers of corrugated board, and a core of at least one plank, where the plank is fiberboard, plywood, oriented stranded material, or an equivalent fastener retaining material, and the feet are shrink wrap covered for strength and its ability to waterproof the feet.

BRIEF DESCRIPTION OF THE DRAWINGS

The invention will be described in conjunction with the accompanying drawings, in which:

FIG. 11 is a perspective view of sheets to be used in forming laminated feet in accordance with an embodiment of the present invention; an FIG. 12 is a side view of the sheets of FIG. 11 compressed into a single sheet in accordance with an embodiment of the present invention;

FIG. 13 is a top view of the laminated sheet of FIG. 12 marked for cutting into feet in accordance with an embodiment of the present invention.

DETAILED DESCRIPTION

Figure 1:
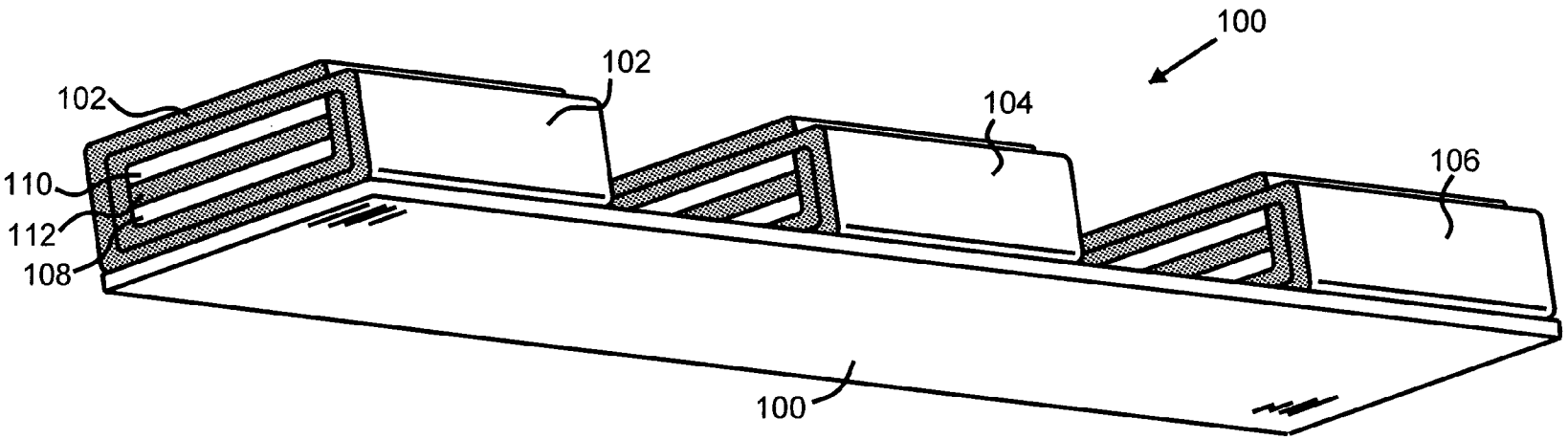
FIG. 1 is a perspective end view of a leg in accordance with an embodiment of the present invention.

It is advantageous to define several terms before describing the invention. It should be appreciated that the following definitions are used throughout this application.

DEFINITIONS

Where the definition of terms departs from the commonly used meaning of the term, applicant intends to utilize the definitions provided below, unless specifically indicated.

For the purposes of the present invention, the term "container" is used interchangeably with the term "crate", and refers to any design of packaging used for transporting of merchandise.

For the purposes of the present invention, the term "feet" refers to structures that are used in combination of two, three, four, etc., to form a leg.

For the purposes of the present invention the term "leg" means a structure formed of a plurality of feet secured together by a common board, and used to support a container or pallet. A plurality of legs is employed in a spaced relationship to provide space for the blades of a forklift or the like to pass between legs and under a container.

For the purposes of the present invention, the term "corrugated" refers to the paper material used for shipping containers, and can be in the form of, for example, single, double, or triple wall, or the like, corrugated board of a desired weight. As used in the feet of the present invention, the corrugated board is used in multiple layers, preferably at least two layers above and below a plank core. The terms "corrugated board" and "corrugated paper" are used interchangeably For the purposes of the present invention, the term "base panel" refers to the shipping container panel that forms the bottom of the container, and to which legs are attached, as by means of an adhesive, nails, staples, or the like.

For the purposes of the present invention, the term "blank" refers to a flat sheet of corrugated board that can be scored and notched, as needed, to form a base panel, top panel, and/or side panels. Additionally, blanks can be used in as a composite laminate and slit into desired sizes to form feet.

For the purposes of the present invention, the term "plank" refers to a thick, flat piece of wood or similar material, having a thickness and structural strength sufficient to retain, bind to, hold, or secure a to nail, screw, staple, or similar fastening device or securing device. Planks can be formed of any material that is generally capable of retaining, binding, holding, or securing a nail, screw, staple, or similar fastening device and includes composite materials, particle board, plywood, composition board, structural foam plastics, composite plastics, and polymeric compositions.

For the purposes of the present invention, the term "securing" refers to the fastening, retaining, binding, holding, or securing a nail, screw, staple, or the like to a fastener retaining plank.

For the purposes of the present invention, the term "pallet" refers to a portable platform used for supporting a crate of cargo for storage or shipping. The terms "pallet" and "skid" are used herein interchangeably.

For the purposes of the present invention, the term "corrugated board" refers the standard corrugated material used for shipping containers. The corrugated board is typically double or triple wall, and can range in weight from 600 to 1100 or greater for triple wall, and from about 300 to 750 for double wall.

For the purposed of the present invention, where the terms "wood" and "plywood" are generally employed, it should be understood that other materials that can function in a manner equivalent to wood and plywood, in respect to the ability to be used in the fastening, attaching, or joining of two or more layers of material together, as with, or as if with a nail. Materials that are generally capable of retaining, binding, holding, or securing a nail, screw, staple, or similar fastening device include composite materials, particle board, plywood, oriented strand board, composition board, structural foam plastics, composite plastics, and polymeric compositions.

For the purposed of the present invention "Oriented Strand Board (OSB)" refers to a product that is manufactured from waterproof heat-cured adhesives and rectangularly shaped wood strands that are arranged in cross-oriented layers, similar to plywood. This results in a structural engineered wood panel that shares many of the strength and performance characteristics of plywood. Produced in huge, continuous mats, OSB is a solid panel product of consistent quality with no laps, gaps, or voids.

OSB is widely used in residential and commercial construction, and is gaining popularity in markets such as materials handling and the manufacturing of upholstered furniture. The manufacturing process makes it possible for panel makers to add innovative features such as a slip-resistant texture to panels designed for roof sheathing, and to supply oversized and metric panels. Detailed and technical information on OSB can be found in the OSB section of the publications store. It contains a complete listing of all APA publications featuring OSB, including case studies, technical sheets, builder tips and more. Of particular interest is APA The Engineered Wood Association, Product Guide, Oriented Strand Board, copyright 1999 APA, 7011 So. 19$^{th}$ street, PO Box 11700, Tacoma, Wash., 98411-0700, (www.apawood.org). OSB panels can be manufactured from a wide range of fast-growing species and from relatively small trees. The production process utilizes a maximum amount of wood fiber from each tree that is harvested, and because the process is very highly automated the yield of finished product is very high.

For the purposed of the present invention the term "fiberboard" refers to cellulosic fiberboard products used for residential and commercial construction, commercial products, and packaging. Fiberboard (cellulosic fiber)—structural and decorative—is a fibrous-felted, homogeneous panel made from ligno-cellulosic fibers—usually wood or cane—which has a density of less than 31 lb/ft3 (497 kg/m3), but more than 10 lb/ft3 (160 kg/m3). Fiberboard is characterized by an integral bond which is produced by interfelting the fibers, but which has not been consolidated under heat and pressure as a separate stage in manufacture. Other materials may be added to fiberboard during manufacture to improve certain properties.

The term "wood" is employed herein as representative of plank materials, and not by way of limitation, since planks can be formed of pressed fiberboard, solid wood, and the like. The critical aspect of an inner layer plank is the ability to hold nails and/or screws on a continuing basis. A material that can hold nails for a short term is not acceptable, since the feet must remain secured to the corrugated shipping container during at least one shipping cycle, and preferably most, if not the entire life of the container. Partial or total separation of a foot from the container during a shipping cycle is not acceptable. Pressed wood board is made with adhesives that contain urea-formaldehyde resins. Some examples of pressed board that are commonly used as building materials are particle board, plywood, and fiberboard.

DESCRIPTION

Figure 5:
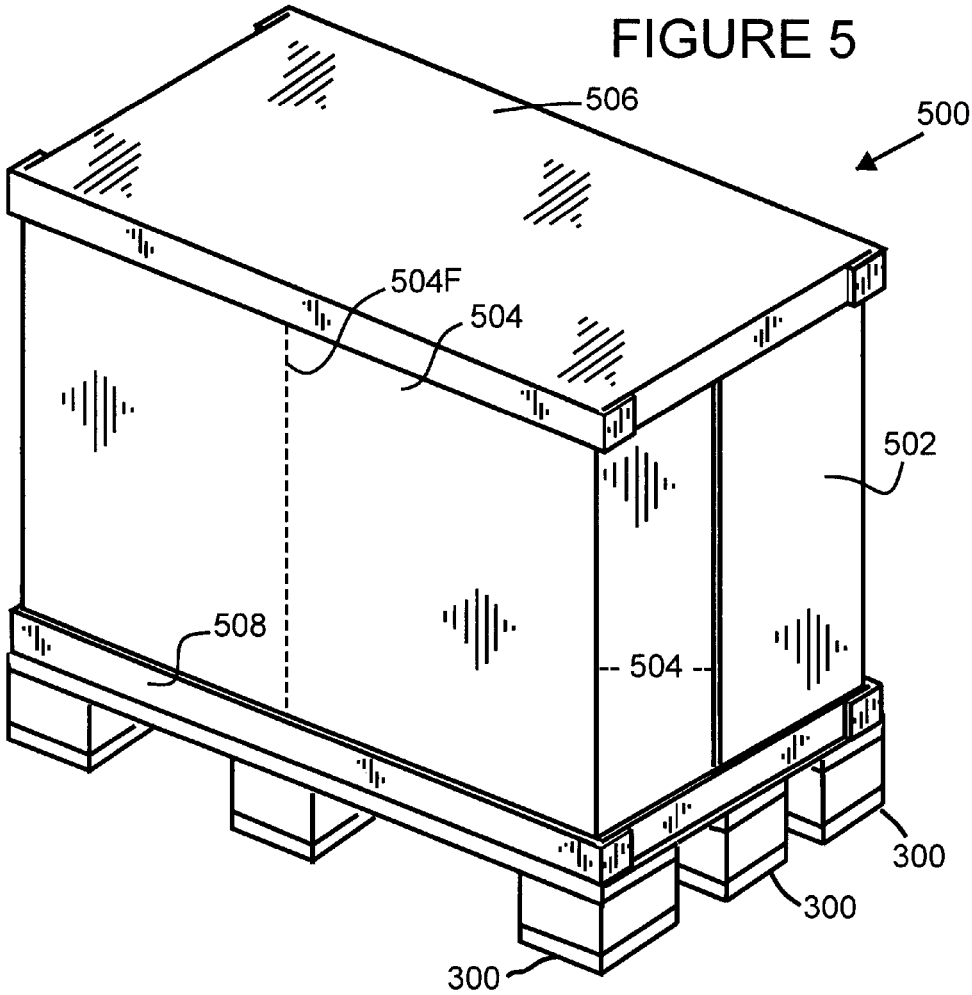
FIG. 5 is a perspective view of a corrugated shipping container with a plurality of spiral corrugated feet shown, in accordance with an embodiment of the present invention.

FIG. 1 shows a leg 100 for use on pallets or containers having a plurality of feet 102, 104, and 106. The feet 102, 104 and 106 are secured to a rail 120 that serves as the bottom of the leg 100. A top member (not shown) to which the leg 100 is secured can be a plywood plank as shown in FIG. 5, or it can be the base of the bottom lid 508 of the container. The feet are multi-component members. The feet 102, 104 and 106 are shown a being formed from a spiral of corrugated board with an inner core 112 of corrugated board, sandwiched between two fastener retaining planks 108 and 110, manufactured from a material such as plywood. The spiral preferable extends at least two "wraps" around the plywood plands 108 and 110 for strength and height. Variations on the number of wraps will be dependent upon strength and height requirements and will be evident to those skilled in the art.

Figure 2:
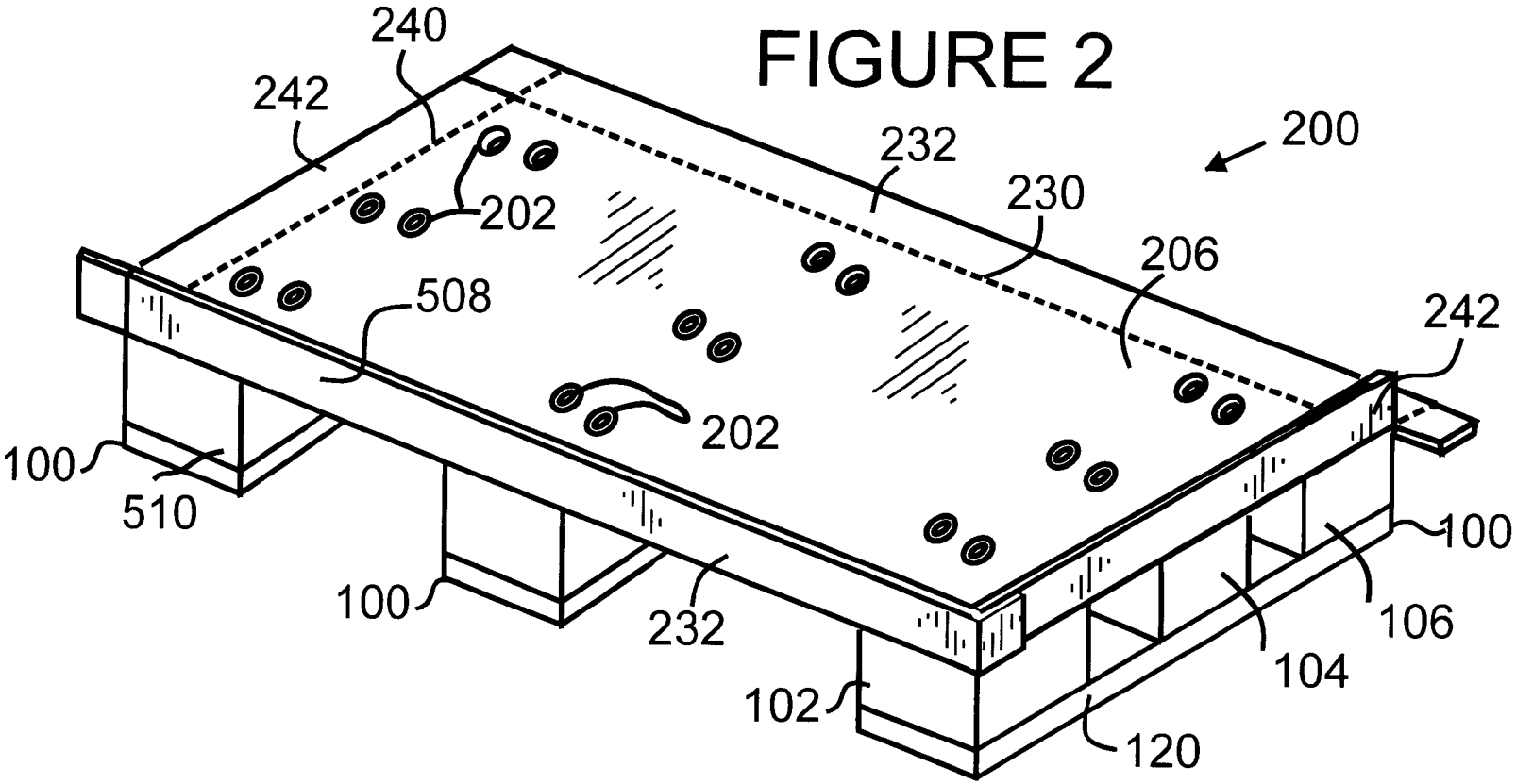
FIG. 2 is perspective view of a base panel of a standard corrugated container secured to a plurality of legs, each leg having a plurality of feet, in accordance with an embodiment of the present invention.

FIG. 2 shows a corrugated blank that forms the base or bottom lid 200 of a shipping container. A set of three legs 100 are shown secured to the base 206 by a plurality of securing members 202, such as nails, screws, staples, or the like. Each of the legs 100 are comprised of feet 102, 104 and 106 secured to a rail 120, as described above. The base 206 is scored at side score lines 230 and end score lines 240 forming side flaps 232 and end flaps 242 respectively. The side flaps 232 and end flaps 242 are folded at right angles to the base 206 and secured to one another, through staples, adhesive or other means, to form a lip around the base 206.

The securing members 202 pass through the corrugated base 206 and become firmly anchored to at least one fastener retaining plank 108 and/or 110 within the feet 102, 104 and 106. While feet 102, 104 and 106 can be adhered to the base 206 by an adhesive, such as a hot melt glue, a co-adhesive, or the like, separation of a foot, or feet, from the shipping container or platform can occur. Accordingly, the use of nails, or the like is highly advantageous, since it provides far greater reliability than adhesives. The use of both nails and adhesive would not be required in most applications.

Figure 3:
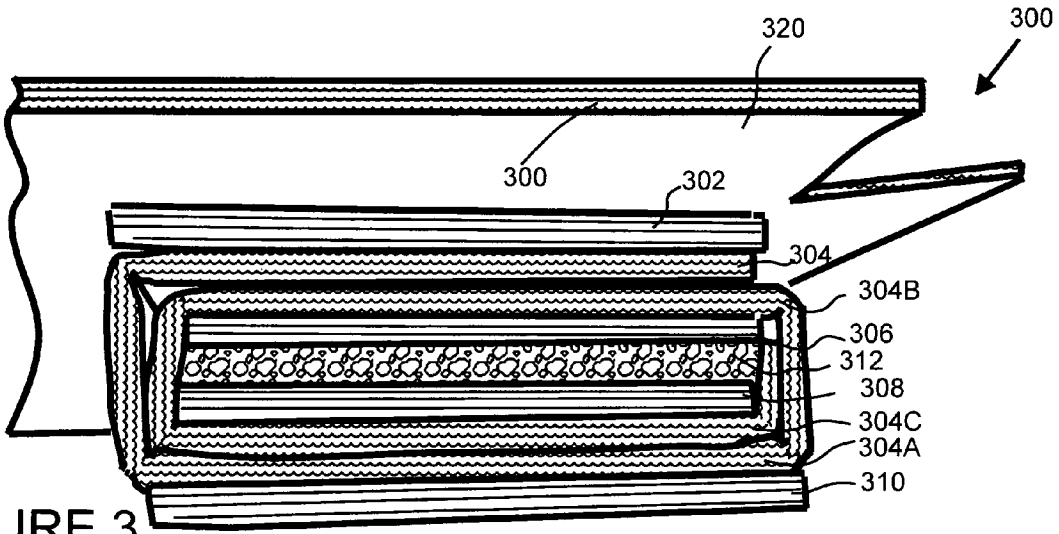
FIG. 3 is an end perspective view of a blank secured to a elongated plank and a foot formed of a spiral of corrugated board, in accordance with another embodiment of the present invention.
Figures 6, 7:
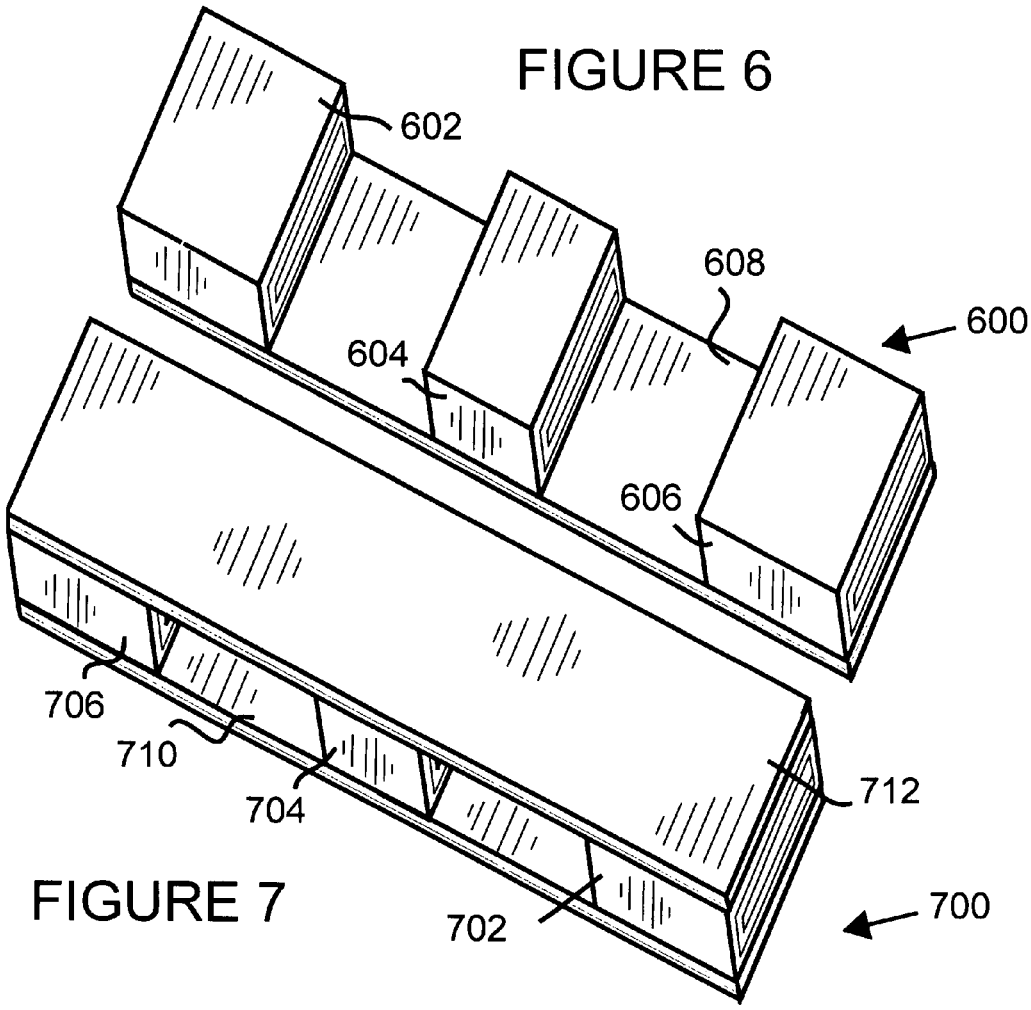
FIG. 6 is perspective view of a leg with three spiral wound corrugated feet, in accordance with another embodiment of the present invention.
FIG. 7 is a perspective view of a leg with three spiral wound corrugated feet and an upper and a lower plywood plank, in accordance with another embodiment of the present invention.

FIG. 3 shows a leg assembly 300 having the corrugated base 300 secured to a plywood plank 302, which in turn is secured to a spiral of corrugated board. The plywood plank 302, preferably, is long enough to carry three feet. The corrugated spiral is seen to have an uppermost layer 304 that extends through a "U" shaped bend to a lower layer 304A, which in turn extends through a "U" turn to a second layer 304B. The process continues and the layer 304B extends through a "U" turn to a sixth layer 304C. Between the second layer 304B and sixth layer 304C is a top plywood plank 306, an inner core of foam 308, and a, bottom plywood plank 308, forming layers three, four, and five, of the foot. In the embodiment of FIG. 3, a plywood plank 310 forms a base layer that spans three feet, as shown in FIG. 6.

Figure 3A:
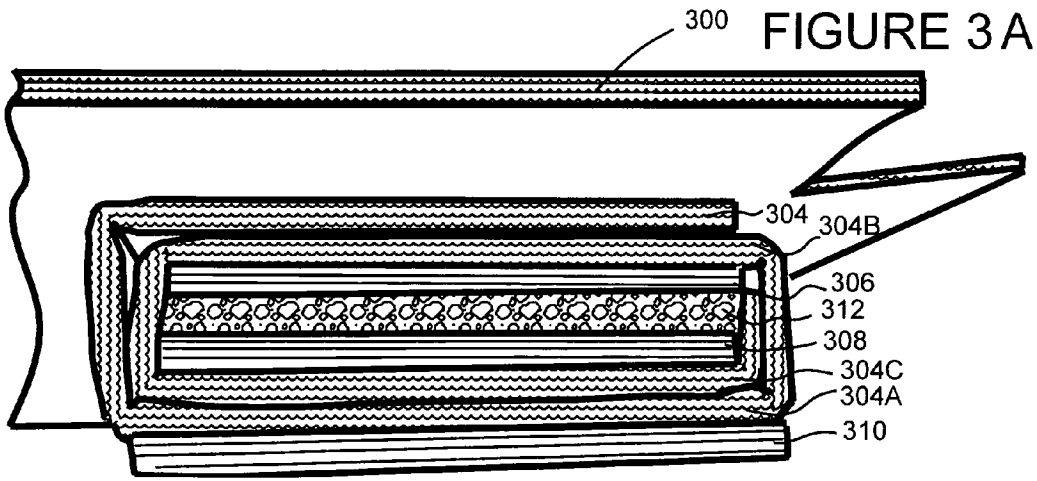
FIG. 3A is an end perspective view of a blank secured to a foot formed of a spiral of corrugated board, in accordance with another embodiment of the present invention.

FIG. 3*a* shows the legs of FIG. 3 without the addition of the plank 302 of FIG. 3. In this embodiment, the uppermost layer 304 of the corrugated spiral is directly affixed to the corrugated base 300.

Figure 4:
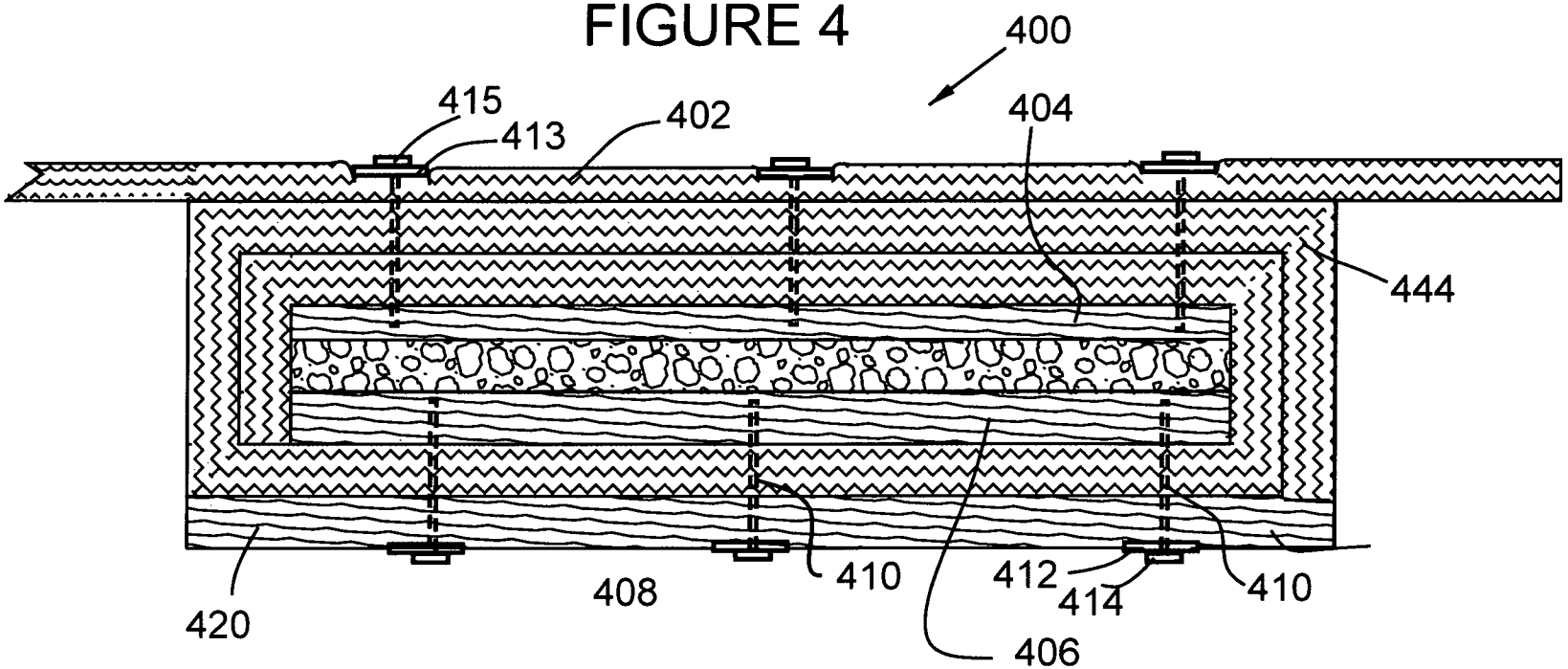
FIG. 4 is side view of a leg formed of spiral wound corrugated board with inner plywood, or other structural material, planks and an impact absorbing inner core of foam having a corrugated base nailed to a plank that forms the bottom layer of the foot, in accordance with another embodiment of the present invention.

FIG. 4 illustrates another embodiment of a leg 400 in which a corrugated spiral 444 forms three layers of a foot, and the inner core 408 is formed of a foam cushion layer, sandwiched between upper plywood plank 404 and lower plywood plank 406. The inner core 408 can alternatively be a layer of corrugated board. Nails 415 are driven through the corrugated base member 402, into at least the upper plywood plank 404. Optionally, the nails can be long enough to pass completely through the upper plywood plank 404, and can penetrate the inner core 408 into the lower plywood plank 406, however this will defeat the cushioning affect of the inner core 408. The use of a washer 413 is preferred to prevent the head of the nail 415 from ripping through the corrugated board 402. Dimpling of the corrugated board is typically minimal. The washer can be a metal, plastic, or other commonly available material. Similarly, the lowermost rail 420 is nailed to at least the lower plywood plank 406. As stated heretofore with respect to the base member 402, the nails 410 securing the rail 420 can also pass through the inner core 408 into the upper plywood plank 404. While the Figure shows the use of a washer 412, the use of a washer is not critical where the nail head is in contact with wood. In the figure illustrated the spiral 444 ends at one side of the foot 400. This design is applicable when used with shrink film, or other covering, however it does not provide sufficient support without a covering.

FIG. 5 shows the leg assembly 300, as illustrated in FIG. 3, in use with a finished/assembled crated 500. The crate is shown with a top lid 506, a bottom lid or base 508, and side panels 502 and 504. It is noted that the panel 504 includes a fold line 504F. The assembly of the crate 500 is described in detail in co-pending application Ser. No. 10/979,138 filed Nov. 3, 2004, to subject matter thereof being incorporated herein by reference as though recited in full.

FIG. 6 shows a leg 600 that is formed from three feet 602, 604, and 606, and a connecting plank 608, while FIG. 7 shows a leg 700 having three feet 702, 704 and 706 sandwiched between two planks 710 and 712, of plywood, or the like.

Figure 8:
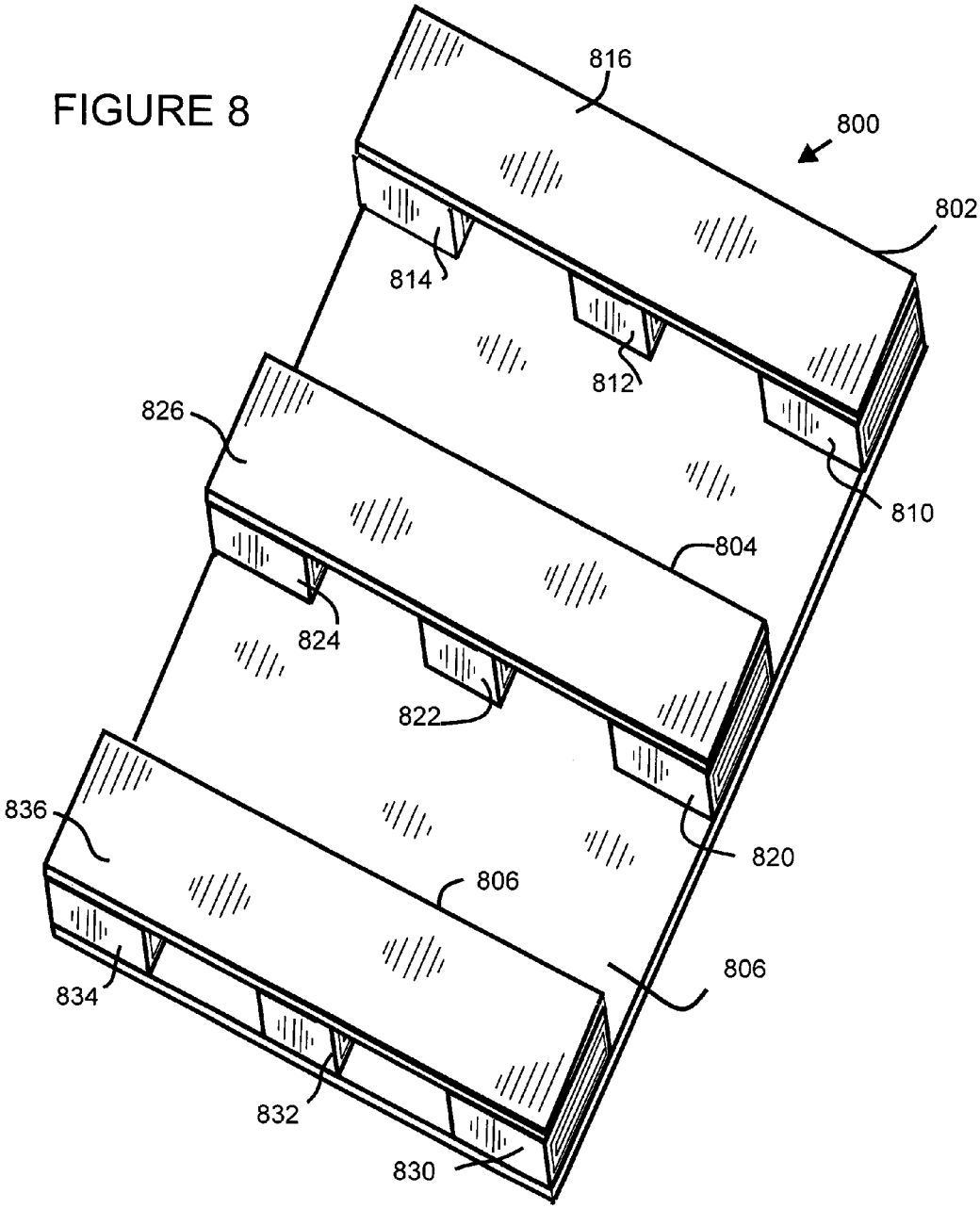
FIG. 8 is a perspective view of a skid formed of three legs secured to a corrugated or plywood base, in accordance with an embodiment of the present invention.

FIG. 8, show a skid 800 using the legs 600 of FIG. 6, assembled into a skid having three legs 802, 804 and 806 and nine feet. Leg 802 includes feet 810, 812, and 814 and rail 816. Similarly, leg 804 includes three feet, 820, 822, and 824 and rail 826, and the third leg, 806, has three feet 830, 832, and 834 and rail 836. The outer most/bottom layer is a plywood plank 808 that spans three legs 802, 804 and 806. The base 808 can be the corrugated base of the container, as previously noted, or it can be a wooden board. It should be noted that rails 816, 826 and 836 form the bottommost surface and is in contact with the floor.

Figure 9:
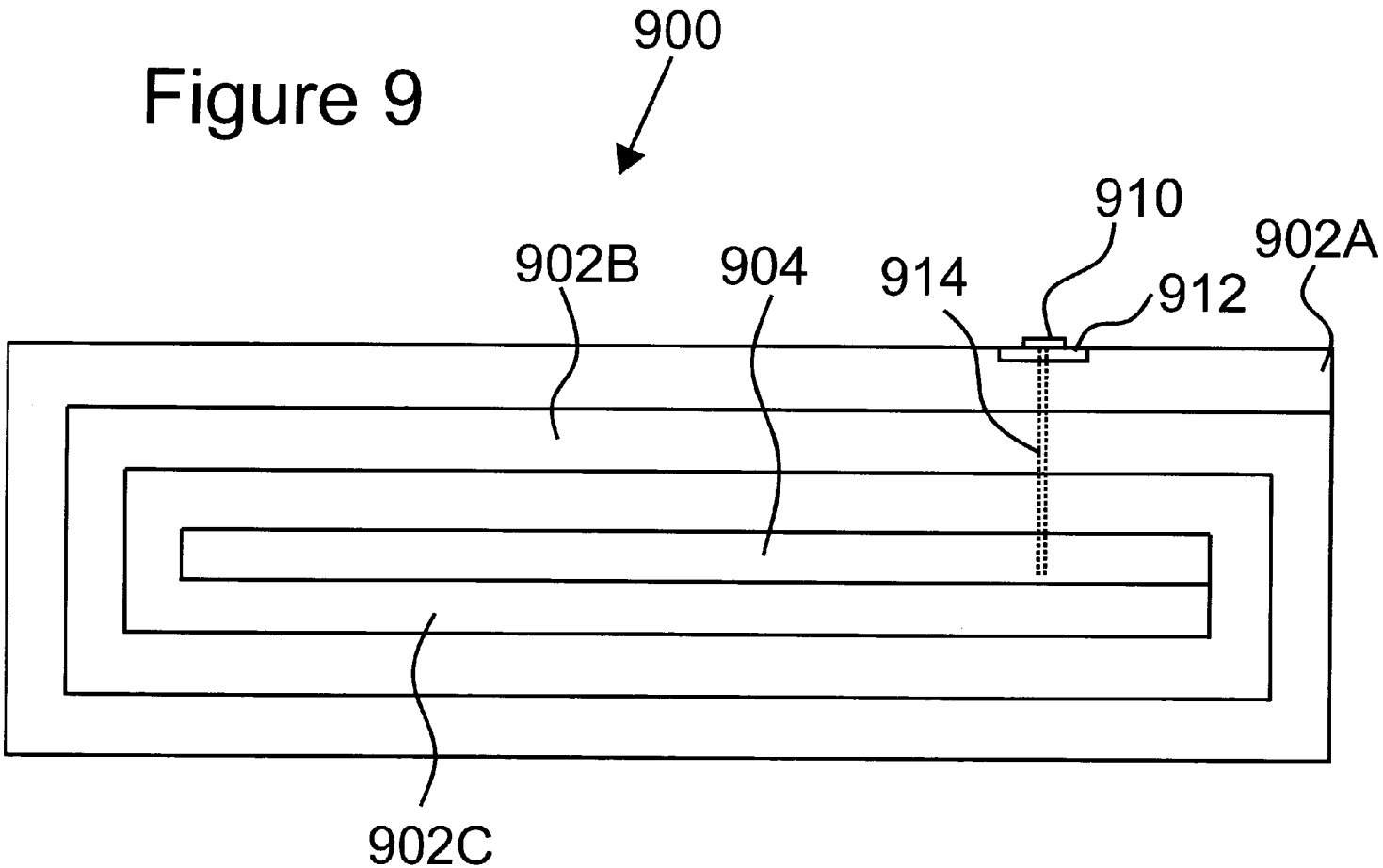
FIG. 9 is a cutaway side view of an alternate foot having a solid core in accordance with an embodiment of the present invention.

FIG. 9 shows an embodiment of a foot 900 in which a single center core of a fastener retaining material 904, such as ⅛, ¼, or ½ inch, or other thickness of plywood, can be employed. The spiral corrugated material has a top layer 902A, a second winding 902B, and a third, inner spiral 902C. As previously noted, staples, nails, screws or the like, fastener 910 is used with a washer 912. The fastener body 914 projects into the retaining material 904. The foot can be held together by a single fastener, such as a nail, positioned as shown for the uppermost right fastener. The use of multiple nails is however, required when fastening the crate to the feet, as shown in FIG. 2.

Figure 10:
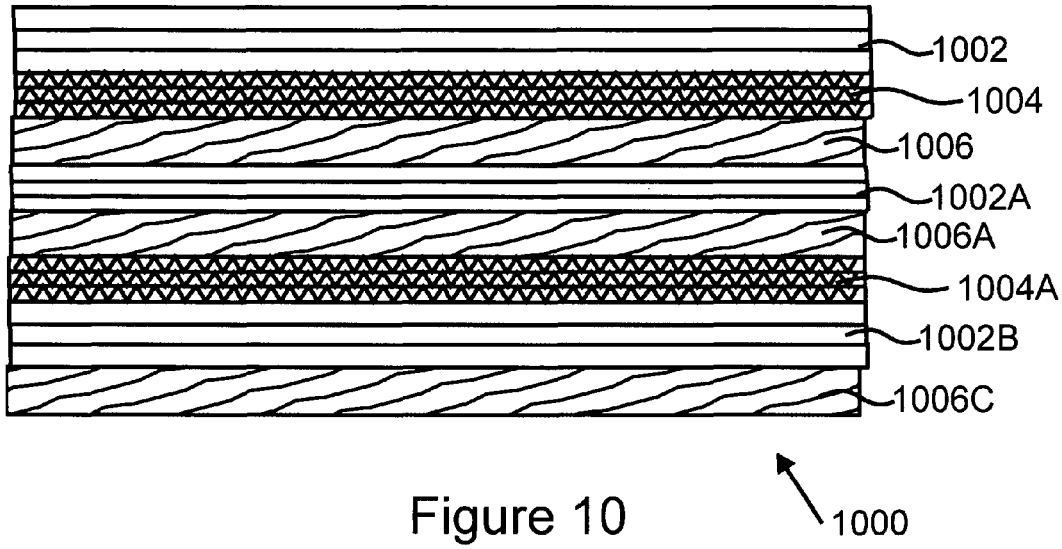
FIG. 10 is a side view of a foot using a combination of oriented corrugated and wood in accordance with an embodiment of the present invention.

FIG. 10 shows a foot indicated generally as 1000, having a top corrugated layer 1002, a cross-grain corrugated layer 1004, and a first plywood layer 1006. Another corrugated layer 1002A is placed on the opposing side of the first plywood layer 1006. Adjacent to the corrugated layer 1002A is a second plywood layer 1006A. Adjacent to the second plywood layer 1006A is a cross-grain corrugated layer 1004A and a third corrugated layer 1002B. The final layer is a third plywood layer 1006C. In this embodiment of the composite feet 900, the layers can be held together by an adhesive of any type, as well known in the art. An advantage of this embodiment is that the feet 900 can be formed from standard 4 foot by 8 foot panels of plywood and corrugated board of the same size.

When the feet are used without a bottom rail the rounded edges of the spiral wound are highly advantageous. In some applications, however, particularly where a rail is employed, and/or cost is an important factor, the feet are preferably in the form of a non-spiral laminate.

In the case of a non-spiral laminate, indicated generally as 1100 of FIG. 11, the sheets or layers of corrugated and plank are bonded, that is, laminated together so as to produce a strong and durable composite structure. Lamination, as employed herein, refers to making of a composite, layered structure by uniting superposed layers of a plurality of materials, and in particular to unite layers of a plurality of materials, preferably with an adhesive; to form by uniting two or more layers in sheet form of a plurality of materials, so that the layers are bonded tightly so as to create a single object with multiple layers, that is, a composite structure.

As seen in FIG. 11, a plurality of layers of materials 1102, 1104, 1106, and 1108, as disclosed above, have an adhesive 1110 applied to at least one surface of each interior layer. The exterior, that is, the top and bottom layers 1102 and 1108 may not have an adhesive applied to the surfaces adjoining adjacent layers 1104 and 1106 as the interior surfaces of 1104 and 1106 have already had an adhesive applied thereto. Where a co-adhesive is used, all interior surface are adhesive coated. Where an adhesive such as a hot melt is used, only one surface need be coated. Thus, as seen in FIG. 11, layers 1108, 1106, and 1104 have a single surface coated with an adhesive.

As shown in FIG. 12, the composite structure is pressed to form a composite laminate. The next step is to cut the composite laminate 1100 as represented by transverse slits 1302 of FIG. 13 and longitudinal slits 1304, to form feet of the desired dimensions, thus producing, as for example 64 feet that are each 6 inches by 12 inches, 96 feet that are 6 by 8 inches, etc. Since the 4 foot by 8 foot composite laminate can be slit into feet of any desired dimensions, one size blank 1100, can be used to produce feet for virtually all applications, thus minimizing inventory concerns and increasing efficiency.

Figure 14:
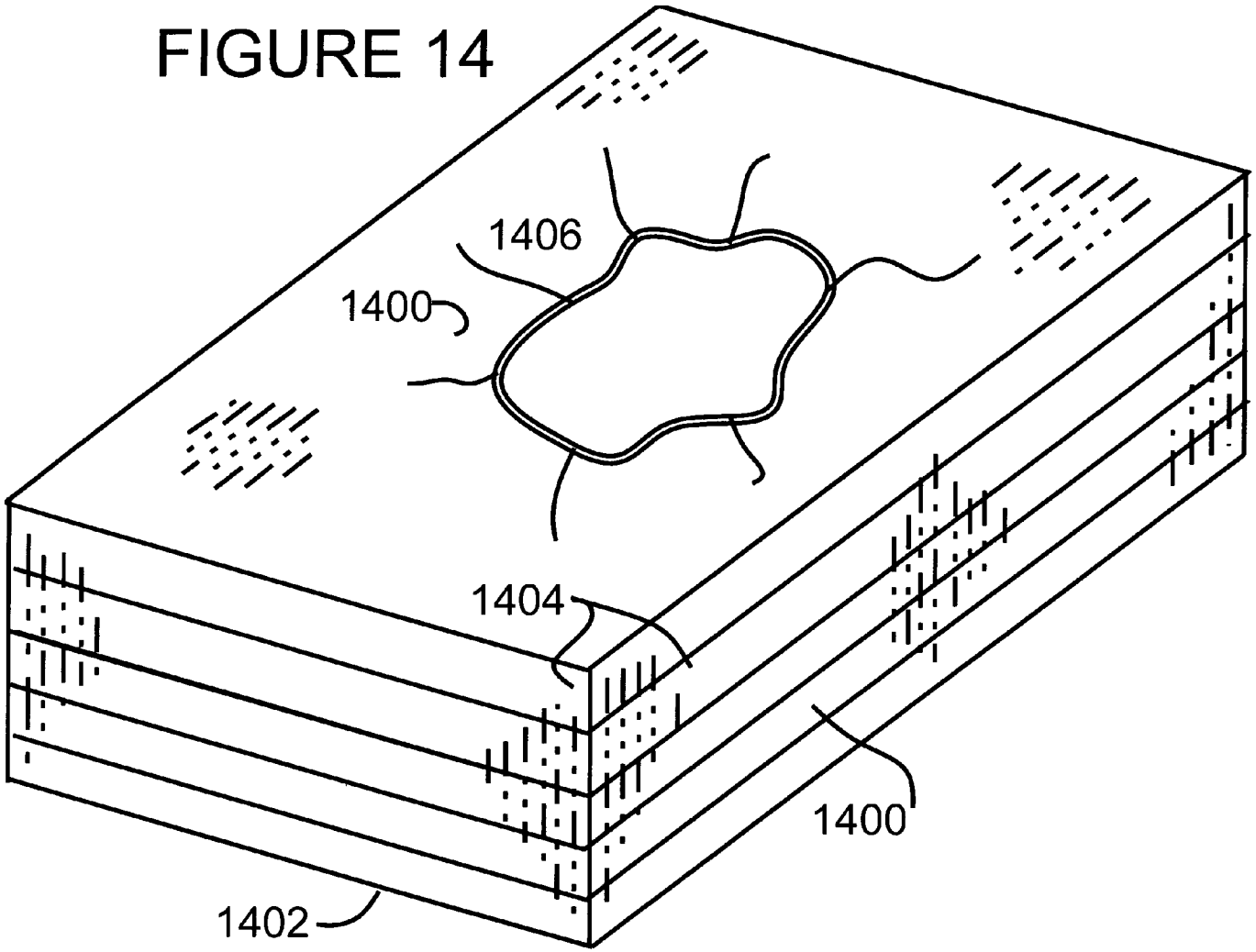
FIG. 14 is a perspective view of in accordance with an embodiment of the present invention.

The waterproofing of the foot, as shown in FIG. 14, is preferably achieved through the use of shrink wrapping 1400 and passing the foot through a heat tunnel. Shrink wrapping is well known in the packaging art as represented, for example, by U.S. Pat. No. 6,722,103 (see FIGS. 14B and 15B), 4,609,101, and 6,293,393 and can be used for encapsulating a product, products, containers, and the like on five or six sides. The most critical sides in the present application are the bottom 1402 and four side surfaces 1404. Typically, the shrink film is typically tubular as seen in FIG. 1 of the '393 patent, there are two bull's-eye openings 1406, one on the top and one on the bottom (not visible), of a foot. Because the shrink wrap is trapped between the upper deck (300 of FIG. 3A or 302 of FIG. 3) and lower rail (310 of FIG. 3), of the skid, the structure becomes completely waterproof. The plywood rail on the bottom is waterproof, and protects the shrink wrap foot integrity by preventing it from being scraped across the floor or scraped by materials riding on the skid.

The legs, feet, their elements, and skid can all be shrink wrapped separately or together in any configuration and number of layers that will provide the desired level of waterproofing. This will be dependent upon the end use and will be known to those skilled in the packaging art.

It should be understood that the composite feet can be used in a range of combinations, with each combination having layers of corrugated board in spiral or non-spiraled form and at least an inner core of plywood or other plank material.

The following table identifies a plurality of representative combinations that can be used, but is not intended to be inclusive of all potential combinations.

| FIG. 4 | FIG. 1 | FIG. 3 | FIG. 3A | Not Illustrated |
|---|---|---|---|---|
| Crate Bottom Lid/Base | Crate Bottom Lid/Base | Crate Bottom Lid/Base | Crate Bottom Lid/Base | Crate Bottom Lid/Base |
| | | wood | | wood |
| corrugated | corrugated | corrugated | corrugated | corrugated |
| corrugated | corrugated | corrugated | corrugated | corrugated |
| Wood | Wood | Wood | Wood | Wood |
| Foam | corrugated | corrugated | Foam | Foam |
| wood | wood | wood | wood | wood |
| corrugated | corrugated | corrugated | corrugated | corrugated |
| corrugated | corrugated | corrugated | corrugated | corrugated |
| Wood Rail | Wood Rail | Wood Rail | | Wood Rail |

| Not Illustrated | FIG. 9 | FIG. 10 | Not Illustrated | Not Illustrated |
|---|---|---|---|---|
| Crate Bottom Lid/Base | Crate Bottom Lid/Base | Crate Bottom Lid/Base | Crate Bottom Lid/Base | Crate Bottom Lid/Base |
| | corrugated | Triple wall Corrugated* | | wood |
| corrugated | corrugated | Triple wall Corrugated * | corrugated | corrugated |
| corrugated | corrugated | Wood | corrugated | corrugated |
| Wood | Wood | Triple wall Corrugated | Wood | Wood |
| Foam | corrugated | Wood | Foam | corrugated |
| wood | corrugated | Triple wall Corrugated** | corrugated | wood |
| corrugated | corrugated | Triple wall Corrugated** | corrugated | corrugated |
| Wood Rail | | Wood Rail | | Wood Rail |

** Indicates optional Cross-grained adjacent layers

Each of the foregoing examples can be encapsulated in a shrink wrap film

The legs of the present invention, unlike corrugated legs of the prior art, can withstand the sideward sliding of a shipping crate, and thus do not require being lifted with a forklift to be moved laterally for a short distance.

Preferably, three legs, each having three feet are used to support a large shipping crate. However, other combinations can be used, as for example, two legs, each having two feet, three legs with a single foot centrally positioned under the crate, etc.

The combinations of inner core components are not limited to wood, corrugated board, and foam, but can include other components, including at least several layers of corrugated and at least one layer of a fastener retaining plank.

Features of the Invention

1. The interleaved wood can be particleboard, plywood, fiberboard, plastic, or any other suitable material that is dense enough for a nail to be held firmly in place.
2. The spiral foot can be made with just one interleaved dense sheet for the purposes of only being nailed to the top tray. This is for lighter duty applications such as a casket crate.
3. The heavier duty applications require two interleaved dense material sheets that enable affixing a plywood and/or a fiberboard bottom runner that runs in one of the directions (length or width).
4. If so required for greater stability, the runners can be shortened on each end by a factor of ½ the width of the foot, and a cross rail that is ½ the width of the foot is added. This creates a square around the exterior of the skid that provides side and length protection from impact. Each foot is connected to a matrix also connects each rail allowing for greater lateral impact strength.
5. The spiral feet are made to be flexible in overall width and length as well as corrugated strength to increase or decrease the vertical strength of the foot. As an example a 6"×8" floor footprint has a crush strength of 950 pounds. An increase in load strength could be done by increasing the length or width or the strength of the corrugated board itself.
6. A preferred method of manufacture for cost and nail-to-interleaved material fastness is to use particle board or OSB (oriented strand board) engineered wood and 90 ECT triplewall as per Tappi standards.
7. The fiberboard alternative is more costly but is enables complete recyclability as opposed to the need to remove the interleaved wood sheets.
8. The composite design creates a durable base, which bypasses the fumigation requirement while keeping the system relatively inexpensive. Plywood is typically expensive, but used in the composite format limits its use to providing a nail receiving structure for durability while using the corrugated for cushioning. The middle layer can be a foam product to provide additional cushioning if needed. The laminate combination does not require fumigation.
9. Typically, nails are power driven and is thus applied with great force. The plastic washer serves to restrict the extent to which the nail penetrates the corrugate sheet. A middle layer of corrugated and/or foam is not contacted by the nail and thus is free to provide cushioning without interference from the nail.
10. In the preferred embodiment, the top board is the base, bottom lid, or bottom sheet of the corrugated container. In a typical application, three composite feet are used in a row and two, three, or four rows can be used to make a skid, depending upon the size of the crate.

All documents, patents, journal articles, and other materials cited in the present application are hereby incorporated by reference.

Although the present invention has been fully described in conjunction with several embodiments thereof with reference to the accompanying drawings, it is to be understood that various changes and modifications may be apparent to those skilled in the art. Such changes and modifications are to be understood as included within the scope of the present invention as defined by the appended claims, unless they depart therefrom.

Broad Scope of the Invention:

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to".

In this disclosure and during the prosecution of this application, means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are not recited. In this disclosure and during the prosecution of this application, the terminology "present invention" or "invention" may be used as a reference to one or more aspect within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure, the following abbreviated terminology may be employed: "e.g." which means "for example".

What is claimed is:

1. A corrugated container system having a base, said base lying in a first plane, a plurality of walls, and a plurality of feet, each of said plurality of feet having a plurality of layers of corrugated board and at least one fastener retaining plank inner core, said plank inner core lying in a second plane and being between multiple layers of spirally wound corrugated board having sections at a right angle to said first plane of said base and sections parallel to said first plane of said base, wherein said at least one fastener retaining plank inner core, is a pair of plank inner cores and further comprising a corrugated inner layer sandwiched between said pair of plank inner cores, each of said plurality of feet being secured to said base by a plurality of fasteners that extend through said base and corrugated layers of said feet, and into said pair of plank inner cores, said second plane of said at least one plank inner core being parallel to said first plane of said base;

further comprising said plank inner core having a first peripheral edge and a second peripheral edge parallel to said first peripheral edge, said spirally wound corrugated board having at least a first section adjacent and parallel to said plank inner core, a second section contiguous with said first section extending at a right angle to the plane of said plank inner core, a third section contiguous with said second section and extending parallel to the plane of said plank inner core, a fourth section contiguous with said third section and extending at a right angle to the plane of said plank inner core, a fifth section contiguous with said fourth section and extending parallel to the plane of said plank inner core, a sixth section contiguous with said fifth section extending at a right angle to the plane of said plank inner core, said plank inner core member having its first peripheral edge at said second section and its second peripheral edge at said fourth section of said spirally wound corrugated board;

further comprising said spirally wound corrugated board having a seventh section contiguous with said sixth section and parallel to the plane of said inner core;

wherein said at least one of said fastener retaining plank inner core is selected from the group consisting of plywood, solid wood, fiber board, pressed board, and oriented strand board.

* * * * *